US005475966A

United States Patent [19]

Renfrow

[11] Patent Number: 5,475,966

[45] Date of Patent: Dec. 19, 1995

[54] APPARATUS FOR UNFOLDING DOCUMENTS

[75] Inventor: Donald F. Renfrow, Richardson, Tex.

[73] Assignee: ElectroCom Automation, L.P., Arlington, Tex.

[21] Appl. No.: 258,246

[22] Filed: Jun. 10, 1994

[51] Int. Cl.[6] ..... B65B 43/26

[52] U.S. Cl. ..... 53/381.1; 493/409; 53/492

[58] Field of Search ..... 493/409, 405, 493/417, 451, 417, 244; 53/492, 391, 381.3, 381.5, 381.6, 381.1

[56] References Cited

U.S. PATENT DOCUMENTS

| | | | |
|---|---|---|---|
| 3,143,100 | 8/1964 | Krupotich | 120/35 |
| 3,238,926 | 3/1966 | Huck | 120/35 |
| 3,384,252 | 5/1968 | West | 214/305 |
| 4,142,430 | 3/1979 | Long et al. | 83/23 |
| 4,233,800 | 11/1980 | Long et al. | 53/381 R |
| 4,373,848 | 2/1983 | Bishop | 414/403 |
| 4,636,192 | 1/1987 | Vogtlander | 493/405 |
| 4,848,126 | 7/1989 | Fryfogle | 493/409 |
| 4,893,454 | 1/1990 | Russell | 53/492 |
| 4,909,021 | 3/1990 | Barbour | 53/492 |
| 5,147,169 | 9/1992 | Miller et al. | 414/403 |
| 5,163,892 | 11/1992 | Morris | 493/405 |

*Primary Examiner*—John Sipos
*Assistant Examiner*—Gene L. Kim
*Attorney, Agent, or Firm*—Harold E. Meier

[57] ABSTRACT

An apparatus for unfolding a bifolded mailpiece comprises a pair of pivotable receiving walls for receiving a bifolded mailpiece, a pair of receiving wall cylinders for pivotally moving the receiving walls and a pair of spreader walls for spreading the bifolded mailpiece received between said receiving walls, the spreader walls being pivotally mounted and actuated by a pair of spreader wall cylinders, a ram being provided for moving the spreader walls along a vertical axis to cooperate with the receiving walls to unfold the mailpiece.

33 Claims, 4 Drawing Sheets

APPARATUS FOR UNFOLDING DOCUMENTS

The present invention relates to a mechanism for unfolding a bifolded mail piece subsequent to processing at an opening station.

BACKGROUND OF THE INVENTION

The ever increasing volume of mail received and processed on a daily basis by many businesses has, in many instances, made manual handling of individual pieces extremely costly and inefficient. The combination of increased volume of mail and rising labor costs created a demand which lead to the development of various mechanized mail and document processing and handling systems. For example, U.S. Pat. No. 5,147,169 to Miller, et al. discloses an automated envelope handling system including a pair of vacuum manifolds positioned on the opposite sides of an envelope travel path to separate the envelope folds. U.S. Pat. No. 4,909,021 to Barbour discloses an automated envelope opener that employs a an envelope opening mechanism for opening a specially designed envelope. The envelope includes slits which allow extracting "fingers" to enter the envelope during the opening process and free a flap in the return address portion of the envelope.

U.S. Pat. No. 4,893,454 to Russell discloses an envelope opening machine that opens three sides of an envelope, leaving the unopened edge in a generally downward position. The machine incorporates opposed elongate folder blades for closing upon the side panels of the envelope and an opposed pair of elongate grasping members including suction cups for engaging opposed panels of the envelope. U.S. Pat. No. 4,373,848 to Bishop discloses an apparatus for exposing contents of an opened envelope with gravity assist. U.S. Pat. No. 4,233,800 to Long, et al. discloses an envelope opener including a peel back station for peeling back the top panel of an envelope to expose the contents of the envelope. U.S. Pat. No. 4,142,430 to Long, et al. also discloses an envelope opener employing a peel back station for peeling back the top panel of an envelope to expose the contents thereof.

U.S. Pat. No. 3,384,252 to West discloses an apparatus for extracting items from envelopes including suction members for engaging the sides of a previously severed envelope. U.S. Pat. No. 3,238,926 to Huck discloses an envelope opening machine that opens a previously severed envelope by transporting it past suction means which cause the top leaf of the envelope to lay back. U.S. Pat. No. 3,143,100 to Krupotich discloses an unfolding mechanism including a mechano-pneumatic envelope opening apparatus in which shiftable envelope engaging heads pneumatically attract the opposite sides of an envelope.

However, none of the foregoing patents provide a mechanism consisting of an apparatus for unfolding a bifolded mailpiece after the edges of the mailpiece have been opened.

SUMMARY OF THE INVENTION

The present invention provides an apparatus for unfolding a bifolded mailpiece comprising a pair of opposed receiving walls for receiving a bifolded mailpiece, the receiving walls each comprising an upper edge, a lower edge and a pair of side edges, a receiving surface and an exterior surface. The receiving walls are pivotally mounted along its lower edge for movement of the upper edge of the receiving wall through a predetermined arc. The receiving walls are provided with a stop for preventing overtravel of a mailpiece inserted between the walls. A pair of receiving wall cylinders are provided for pivotally moving the receiving walls as the mailpiece is unfolded.

A spreader mechanism is also incorporated into the unfolding apparatus to aid in spreading the mailpiece. The spreader mechanism includes a pair of spreader walls mounted on pivotable members for movement of the upper edge of the spreader wall through a predetermined arc. The spreader walls are pivoted utilizing a pair of spreader wall cylinders that are hinged to the pivotable members. The spreader mechanism includes a ram for moving the mechanism along a vertical axis whereby the mailpiece is trapped between the receiving walls and the spreader walls as the spreader mechanism is lowered. Thus, the present invention provides a novel means for unfolding a bifolded mailpiece in a mechanized mail handling system.

DETAILED DESCRIPTION

Figure 1:
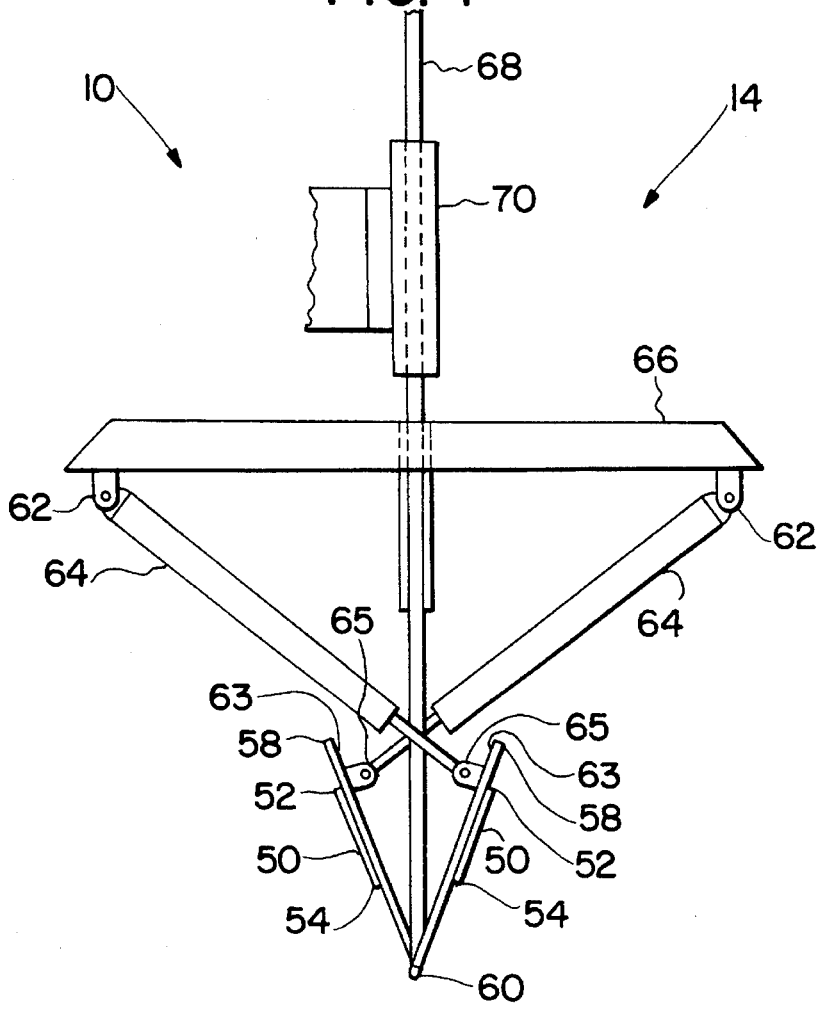
FIG. 1 is a front perspective view of the spreader mechanism apparatus of the present invention in the closed position.
Figure 2:
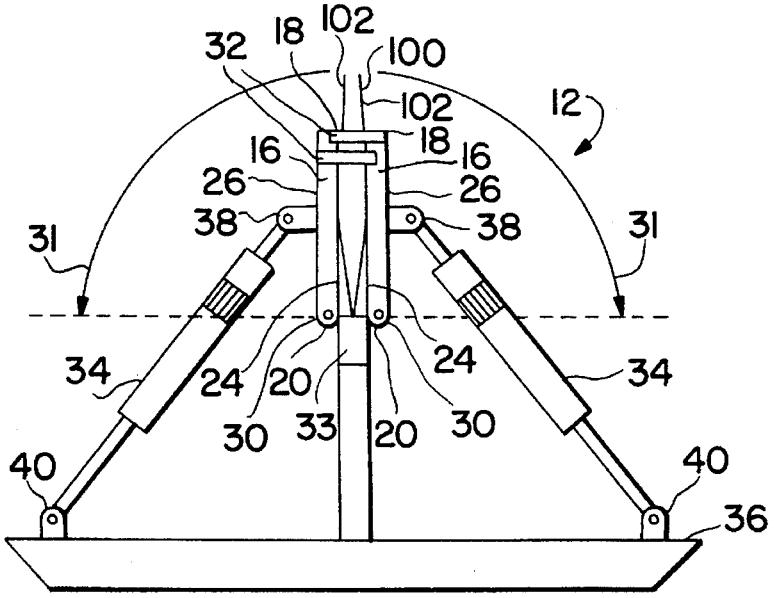
FIG. 2 is a front perspective view of the receiving mechanism apparatus of the present invention in the closed position.
Figure 3:
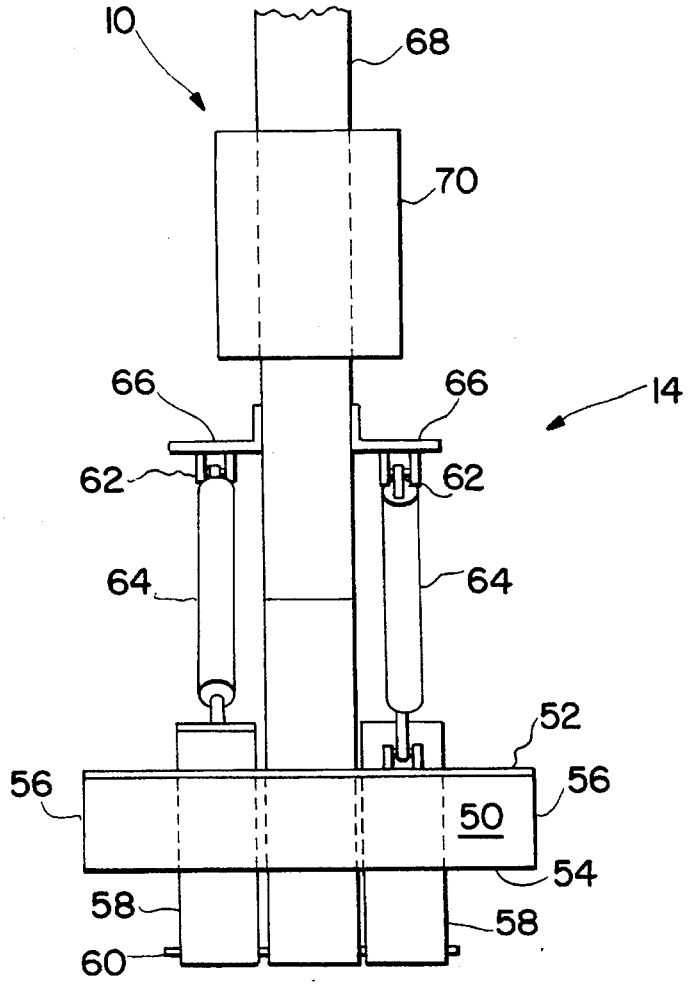
FIG. 3 is a side perspective view of the spreader mechanism apparatus of the present invention in the closed position.
Figure 4:
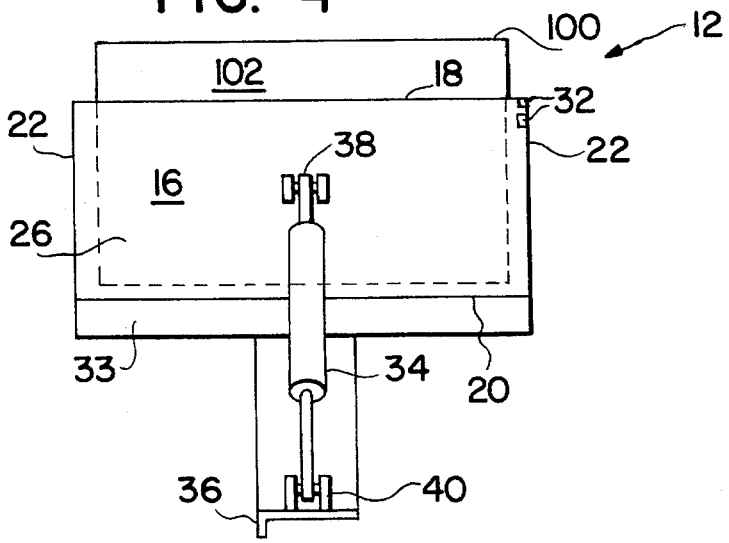
FIG. 4 is a side perspective view of the receiving mechanism apparatus of the present invention in the closed position.

Referring now to FIGS. 1–4, the unfolding apparatus 10 of the present invention includes a receiving mechanism 12 and a spreader mechanism 14. The receiving mechanism 12 includes a pair of opposed receiving walls 16 each have an upper edge 18, a lower edge 20, pair of side edges 22, receiving surfaces 24 and exterior surfaces 26. As illustrated, the receiving walls 16 are substantially rectangular, however, other geometries may be employed. Each of the receiving walls 16 is pivotally mounted along its lower edge 20 to spine 33 with a hinge 30. A bifolded mailpiece 100 is positioned between receiving walls 16 for unfolding. The top and side edges of the mailpiece 100 have been opened at an opening station (not shown) prior to being transported to the unfolding apparatus 10. The mailpiece 100 is conveyed to the unfolding apparatus 10 from the opening station by any appropriate means, for example pinched between two opposed conveyor belts. The bifolded mailpiece 100 is inserted between the receiving walls 16 with the sides 102 of the mailpiece 100 positioned adjacent to the receiving surfaces 24. Stops 32 are mounted on receiving walls 16 to prevent overtravel of the mailpiece 100 as it is inserted between the receiving surfaces 24.

In one embodiment of the invention, the height of the receiving walls 16 is less than one-half of the length of the mailpiece to be unfolded. For example, if the mailpiece 100 is a bifolded 8.5 by 11 inch document, the height of the receiving walls 16 may be approximately 4 inches, leaving approximately 1.5 inches of the bifolded mailpiece projecting above the top edges 18 of the receiving walls 16.

Receiving wall cylinders 34 are mounted on a base 36 and are connected to the external surfaces 26 of the receiving walls 16 with hinges 38 and to the base 36 with hinges 40 for pivotally moving the receiving walls 16 during the unfolding operation. Receiving wall cylinders 34 may be conventionally driven by hydraulic, pneumatic or electrical means as will be appreciated by those skilled in the art. Upon actuation of receiving wall cylinders 34, the receiving walls 16 pivot on hinges 30 and the upper edges 18 of the receiving walls 16 travel parallel to arc 31.

Spreader mechanism 14 includes a pair of spreader walls 50 each comprising an upper edge 52, a lower edge 54 and a pair of side edges 56. Each of the spreader walls 50 is mounted on a pivotable member 58. The members 58 are pivotally connected with hinge 60. Spreader wall cylinders 64 are mounted on support structure 66 with hinges 62 and connected to the inside surfaces 63 of the pivotable member 58 with hinges 65 for pivotally moving the spreader walls 50 upon actuation of the spreader wall cylinders 64. The spreader assembly 14 is mounted on a ram 68 for movement in the vertical direction. A ram guide 70 is provided to control lateral movement of the ram 68 as the spreader assembly 14 is moved vertically. The ram 68 may be driven by any conventional means, for example by a pneumatic or hydraulic cylinder or a rack and pinion drive.

Figure 5:
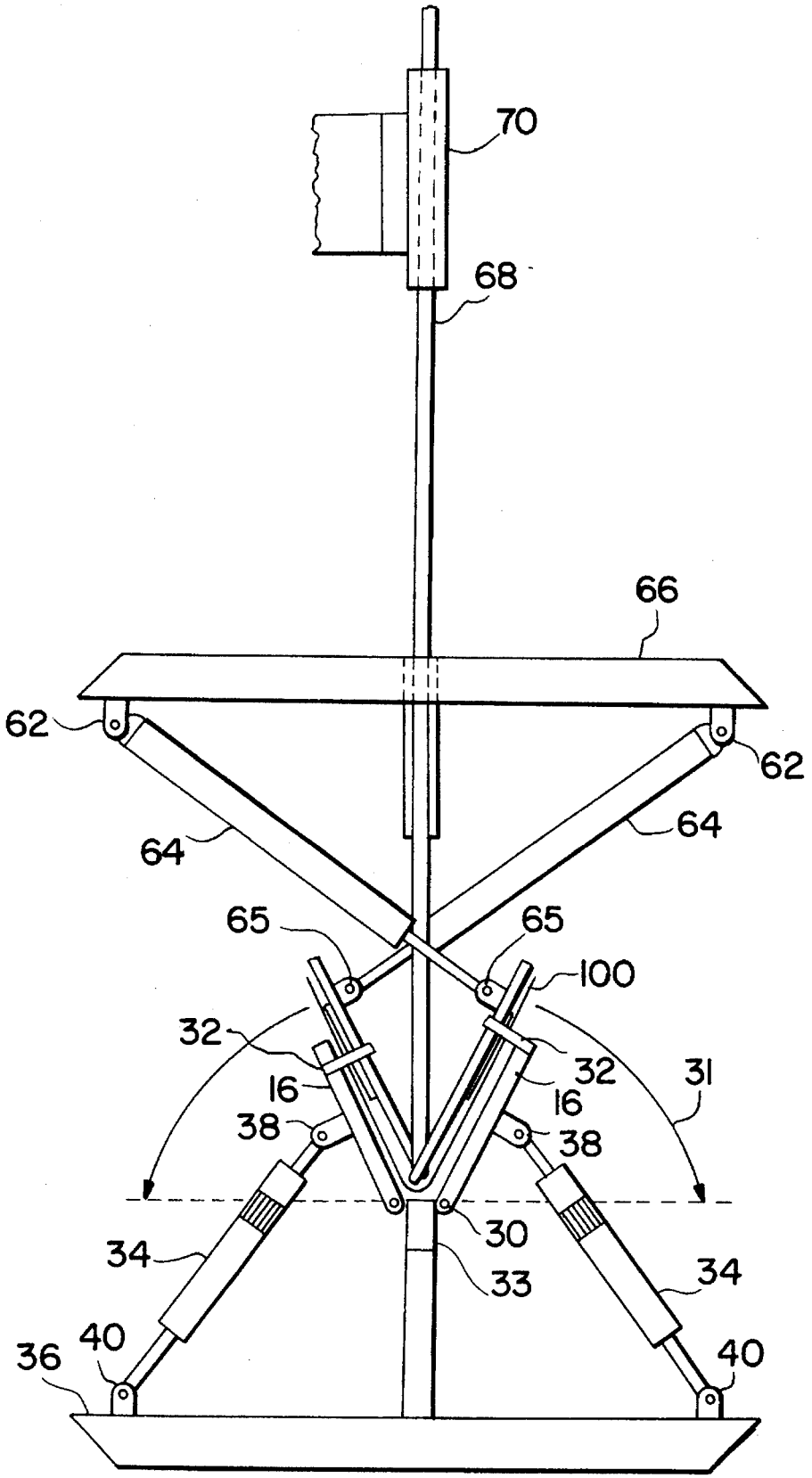
FIG. 5 is a front perspective view of the unfolding apparatus of the present invention in a partially opened position.

Referring now to FIG. 5, receiving wall cylinders 38 are actuated to pivot the receiving walls 16 to a predetermined angle. For example, the receiving walls 16 may each be pivoted simultaneously approximately 15°, creating a total angle or opening between the receiving walls 16 of approximately 30°. Due to the natural spring and resiliency of the folded paper, the mailpiece 100 will tend to unfold as the receiving walls 16 are pivoted, creating an opening between the sides 102 of the mailpiece 100. As the mailpiece 100 unfolds, ram 68 is actuated and spreader mechanism 14 is lowered, trapping the mailpiece 100 between the receiving walls 16 and the spreader walls 50.

Figure 6:
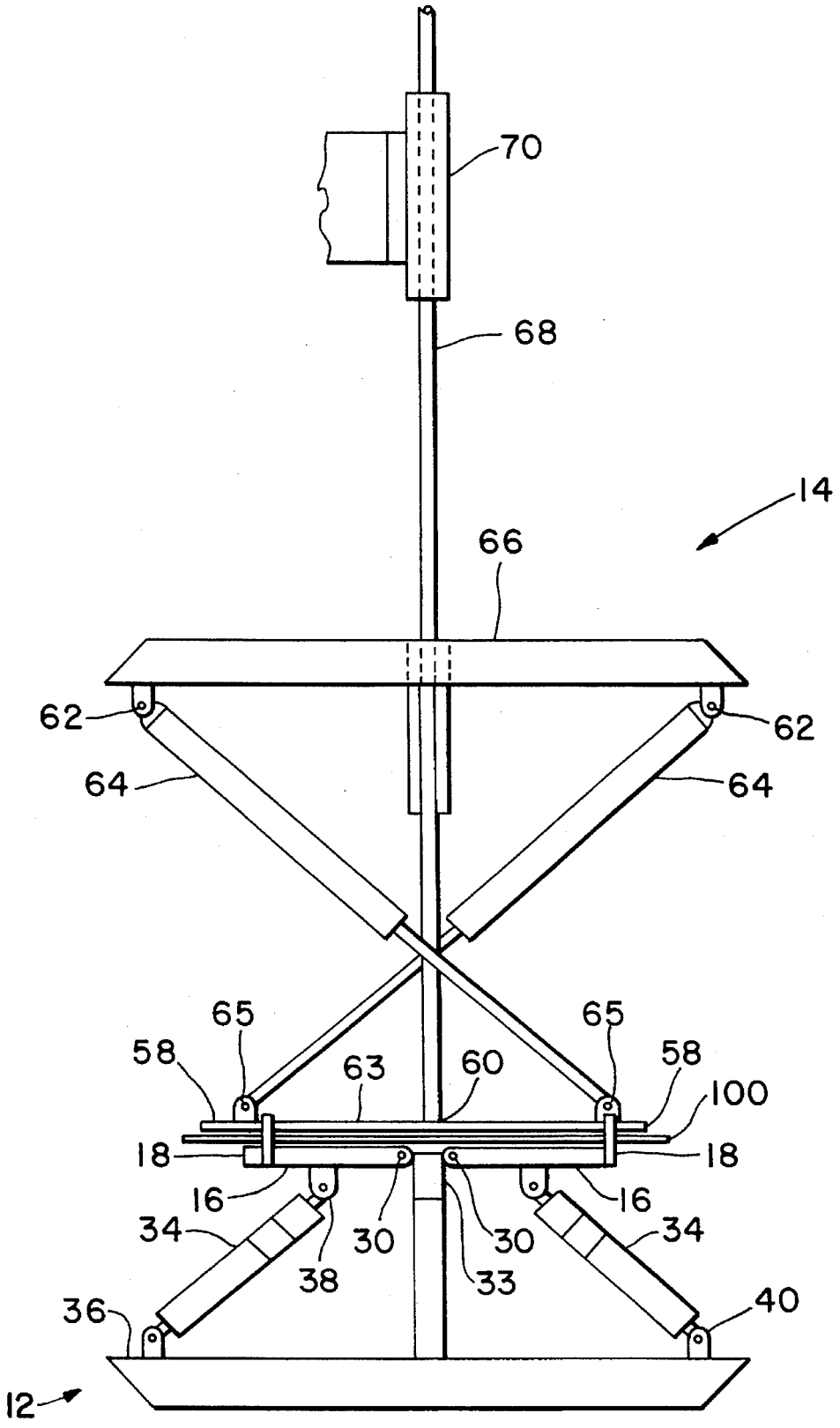
FIG. 6 is a front perspective view of the unfolding apparatus of the present invention in a fully opened position.

As best illustrated by FIG. 6, receiving wall cylinders 38 and spreader wall cylinders 64 may be simultaneously activated to pivot receiving walls 16 and spreader walls 50 to a horizontal position. At this point, the top edges 18 of the receiving walls 16 have each traveled through a predetermined or preselected arc of approximately 90° as the receiving walls 16 are pivoted under the action of the receiving wall cylinders 38. The top edges 52 of spreader walls 50 have travelled through a parallel predetermined arc of lesser degree during the unfolding operation. The receiving wall cylinders 34 are fully retracted and the spreader wall cylinders 64 are fully extended as the unfolding operation is completed.

In the illustrated embodiment, the height of receiving walls 16 and spreader walls 50 is less than one-half the length of the mailpiece to be unfolded, leaving portions of the mailpiece 100 extending beyond the upper edges 18 and 52, respectively, of the receiving wall 16 and spreader wall 50. The portion of the mailpiece extending beyond the receiving wall 16 and spreader wall 50 may then be grasped by a robot end effector or transport carrier for transfer to the next work station in the system.

As will be appreciated by those skilled in the art, actuation of the unfolder apparatus of the present invention may be controlled through the operation of conventional sensing and control means such as photocells, solenoid switches, microswitches and microprocessors and may be automated and synchronized with other devices in a mechanized mail handling system.

While particular embodiments of the present invention have been illustrated in the accompanying drawings and described in the foregoing Detailed Description, it will be apparent to those skilled in the art that various changes and modifications may be made without departing from the spirit and scope of the invention. The following claims are intended to cover all such modifications, rearrangements and substitution of parts and elements.

I claim:

1. An apparatus for unfolding a bifolded mailpiece comprising:

a pair of receiving walls for receiving a bifolded mailpiece, said receiving walls each comprising an upper and lower edge, each of said receiving walls being pivotally mounted along the lower edge of said receiving wall;

at least one receiving wall cylinder for pivotally moving said receiving walls relative to each other;

a pair of spreader walls adapted to fit within the bifolded mailpiece for spreading a bifolded mailpiece received between said receiving walls, each spreader wall comprising an upper and lower edge, each of said spreader walls being mounted for pivotable movement relative to the other wall;

at least one spreader wall cylinder for pivotally moving said spreader walls; and a ram for moving said spreader walls along a vertical axis into the interior of the mailpiece.

2. The apparatus of claim 1 further comprising a ram guide for controlling lateral movement of the ram.

3. The apparatus of claim 1 further comprising a stop for retaining a mailpiece inserted between said receiving walls.

4. The apparatus of claim 1 wherein the lower edge of each said receiving wall is pivotally mounted for movement of the upper edge of said receiving wall through a predetermined arc.

5. The apparatus of claim 1 wherein each said spreader wall is pivotally mounted for movement of the upper edge of said spreader wall through a predetermined arc.

6. The apparatus of claim 1 further comprising a pair of receiving wall cylinders for pivotally moving said receiving walls, each of said receiving wall cylinders being coupled to one of said receiving walls for movement of the upper edge of said receiving wall through a predetermined arc.

7. The apparatus of claim 6 wherein said predetermined arc is about 90°.

8. The apparatus of claim 1 wherein the height of said receiving walls is less than one-half of the length of the mailpiece to be unfolded.

9. The apparatus of claim 1 further comprising a pair of spreader wall cylinders for pivotally moving said spreader walls, each of said spreader wall cylinders being coupled to one of said spreader walls for pivotal movement of said spreader wall.

10. An apparatus for unfolding a bifolded mailpiece comprising:

a pair of receiving walls for receiving a bifolded mailpiece, said receiving walls each comprising an upper and lower edge, each of said receiving walls further comprising a receiving surface and an exterior surface, each of said receiving walls being pivotally mounted along the lower edge of said receiving wall;

a pair of receiving wall cylinders for pivotally moving said receiving walls relative to each other, each of said receiving wall cylinders being coupled to one of said receiving walls;

a pair of spreader walls adapted to fit within the bifolded mailpiece for spreading a bifolded mailpiece received between said receiving walls, said spreader walls each comprising an upper and lower edge, each of said spreader walls being pivotally mounted relative to the other wall;

a pair of spreader wall cylinders for pivotally moving said spreader walls; and a ram for moving said spreader walls along a vertical axis into the interior of the mailpiece.

11. The apparatus of claim 10 further comprising a ram guide for controlling lateral movement of the ram.

12. The apparatus of claim 10 further comprising a stop for retaining a mailpiece inserted between said receiving walls.

13. The apparatus of claim 10 wherein the lower edge of each said receiving wall is pivotally mounted for movement of the upper edge of said receiving wall through a predetermined arc.

14. The apparatus of claim 13 wherein said predetermined arc is about 90°.

15. The apparatus of claim 10 wherein the height of said receiving walls is less than one-half of the length of the mailpiece to be unfolded.

16. An apparatus for unfolding a bifolded mailpiece comprising:

a pair of receiving walls for receiving a bifolded mailpiece, said receiving walls each comprising an upper and lower edge, each of said receiving walls further comprising a receiving surface and an exterior surface, each of said receiving walls being pivotally mounted along the lower edge of said receiving wall for movement of the upper edge of the receiving wall through a predetermined arc of about 90°;

at least one receiving wall cylinder for pivotally moving said receiving walls relative to each other;

a pair of spreader walls for spreading a bifolded mailpiece received between said receiving walls, said spreader walls each comprising an upper and lower edge, each of said spreader walls being pivotally mounted;

at least one spreader wall cylinder for pivotally moving said spreader walls relative to each other; and a ram for moving said spreader walls along a vertical axis into the interior of the mailpiece.

17. The apparatus of claim 16 further comprising a stop for retaining a mailpiece inserted between said receiving walls.

18. The apparatus of claim 16 further comprising a ram guide for controlling lateral movement of said ram.

19. The apparatus of claim 16 wherein the height of said receiving walls is less than one-half of the length of the mailpiece to be unfolded.

20. The apparatus of claim 16 further comprising a pair of receiving wall cylinders for pivotally moving said receiving walls, and a pair of spreader wall cylinders for pivotally moving said spreader walls.

21. An apparatus for unfolding a bifolded mailpiece comprising:

receiving means for receiving a bifolded mailpiece;

pivoting means to separate the bifolded mailpiece and for pivotally moving said receiving means;

spreader means adapted to fit within the bifolded mailpiece for spreading the bifolded mailpiece received in said receiving means;

spreader pivoting means for pivotally moving said spreader means; and vertical movement means for moving said spreader means along a vertical axis to move into the interior of the mailpiece.

22. The apparatus of claim 21 wherein said receiving means comprises a pair of receiving walls for receiving a bifolded mailpiece, said receiving walls each comprising an upper and lower edge, each of said receiving walls being pivotally mounted along the lower edge of said receiving wall.

23. The apparatus of claim 21 wherein said pivoting means comprises at least one receiving wall cylinder for pivotally moving said receiving walls.

24. The apparatus of claim 21 wherein said spreader means comprises a pair of spreader walls for spreading a bifolded mailpiece received between said receiving walls, each spreader wall comprising an upper and lower edge, each of said spreader walls being mounted for pivotable movement.

25. The apparatus of claim 21 wherein said spreader pivoting means comprises at least one spreader wall cylinder for pivotally moving said spreader walls.

26. The apparatus of claim 21 wherein said vertical movement means comprises a ram for moving said spreader means along a vertical axis.

27. The apparatus of claim 22 further comprising a stop for retaining a mailpiece inserted between said receiving walls.

28. The apparatus of claim 22 wherein the lower edge of each said receiving wall is pivotally mounted for movement of the upper edge of said receiving wall through a predetermined arc.

29. The apparatus of claim 22 wherein the height of said receiving walls is less than one-half of the length of the mailpiece to be unfolded.

30. The apparatus of claim 22 further comprising a pair of receiving wall cylinders for pivotally moving said receiving walls, each of said receiving wall cylinders being coupled to one of said receiving walls for movement of the upper edge of said receiving wall through a predetermined arc.

31. The apparatus of claim 30 wherein said predetermined arc is about 90°.

32. The apparatus of claim 24 wherein each said spreader wall is pivotally mounted for movement of the upper edge of said spreader wall through a predetermined arc.

33. The apparatus of claim 26 further comprising guide means for controlling lateral movement of the ram.

* * * * *